US008628090B2

(12) United States Patent
Levin

(10) Patent No.: US 8,628,090 B2
(45) Date of Patent: Jan. 14, 2014

(54) SEASHELL GAME

(76) Inventor: Robert Levin, Navarre, FL (US)

( * ) Notice: Subject to any disclaimer, the term of this patent is extended or adjusted under 35 U.S.C. 154(b) by 0 days.

(21) Appl. No.: 13/353,670

(22) Filed: Jan. 19, 2012

(65) Prior Publication Data

US 2012/0193871 A1 Aug. 2, 2012

Related U.S. Application Data

(60) Provisional application No. 61/438,816, filed on Feb. 2, 2011.

(51) Int. Cl.
*G09B 23/26* (2006.01)
*A63F 9/00* (2006.01)

(52) U.S. Cl.
USPC ..... 273/287; 273/309; 273/282.1; 273/459; 434/296; 434/297; 434/429

(58) Field of Classification Search
USPC ..... 273/309, 282.1, 285, 287, 148 R, 459; 434/429, 297, 296, 295, 299
See application file for complete search history.

(56) References Cited

U.S. PATENT DOCUMENTS

| | | | | | |
|---|---|---|---|---|---|
| 3,130,973 | A | * | 4/1964 | Zapolski | 273/245 |
| D330,805 | S | * | 11/1992 | Yang | D3/302 |
| 5,462,167 | A | * | 10/1995 | Polinski et al. | 206/455 |
| 5,605,330 | A | * | 2/1997 | Huang et al. | 273/142 R |
| 5,944,532 | A | * | 8/1999 | Lienhop | 434/295 |

* cited by examiner

*Primary Examiner* — Benjamin Layno
(74) *Attorney, Agent, or Firm* — Padowithz Alce; MVA

(57) ABSTRACT

Children and adults are often seen collecting shells at the beach. Most don't know the name of the shell or anything about it. There's a need to create interest and education about seashells.

There is literature which identifies seashells but nothing in the form of a game which would spark that interest.

I've invented a seashell game geared for specific geographic locations that identifies indigenous seashells. The game consists of a plastic board with several indentations for specific shells to be placed into. A picture of that shell, its name and interesting information is printed next to the appropriate indentation. The object of the game is for players to fill each indentation with the proper shell within a time limit.

The game provides a fun way to learn about seashells and occupy one's time while at the beach. Once filled, the game can be displayed in home, school or office.

2 Claims, 3 Drawing Sheets

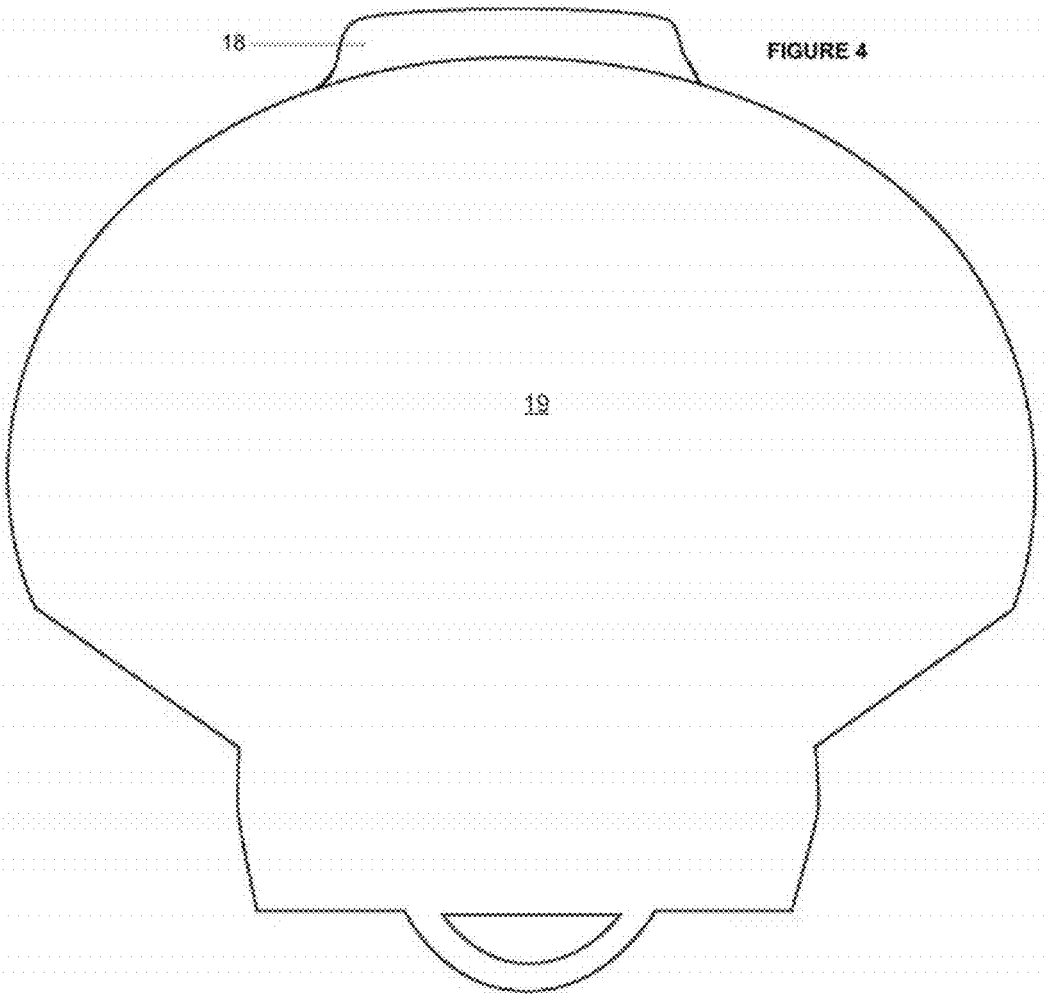
FIGURE 4
FIGURE 5
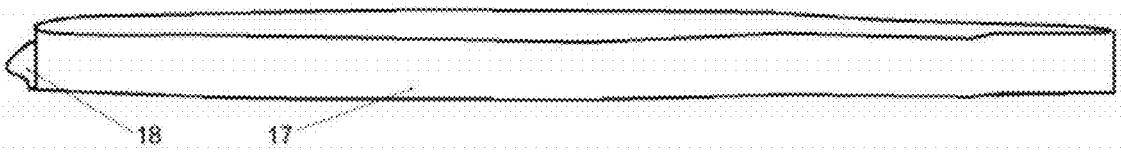

SEASHELL GAME

This application is based upon a provision patent application Appl. No. 61/438,816 filing date Feb. 2, 2011.

BRIEF DESCRIPTION OF THE DRAWINGS

FIG. 4 is a top plan view of a cover according to an embodiment of the present invention; and FIG. 5 is a side perspective view of the cover shown in FIG. 4.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention generally provide a seashell game, comprising a game base having a game face, a plurality of ribs formed on the game face, a plurality of indents formed on the game face, a label on the game face, and a cover configured to fit over the game face. Aspects of the seashell game may allow one or more players to take part in a scavenger hunt for seashells that may be played on a beach. The face of the seashell game may include illustrations, names, and other information pertaining to the seashell game, wherein players compete to accrue point values that may be awarded to players for a seashell obtained by the player and the relative size of the seashell obtained.

Figure 1:
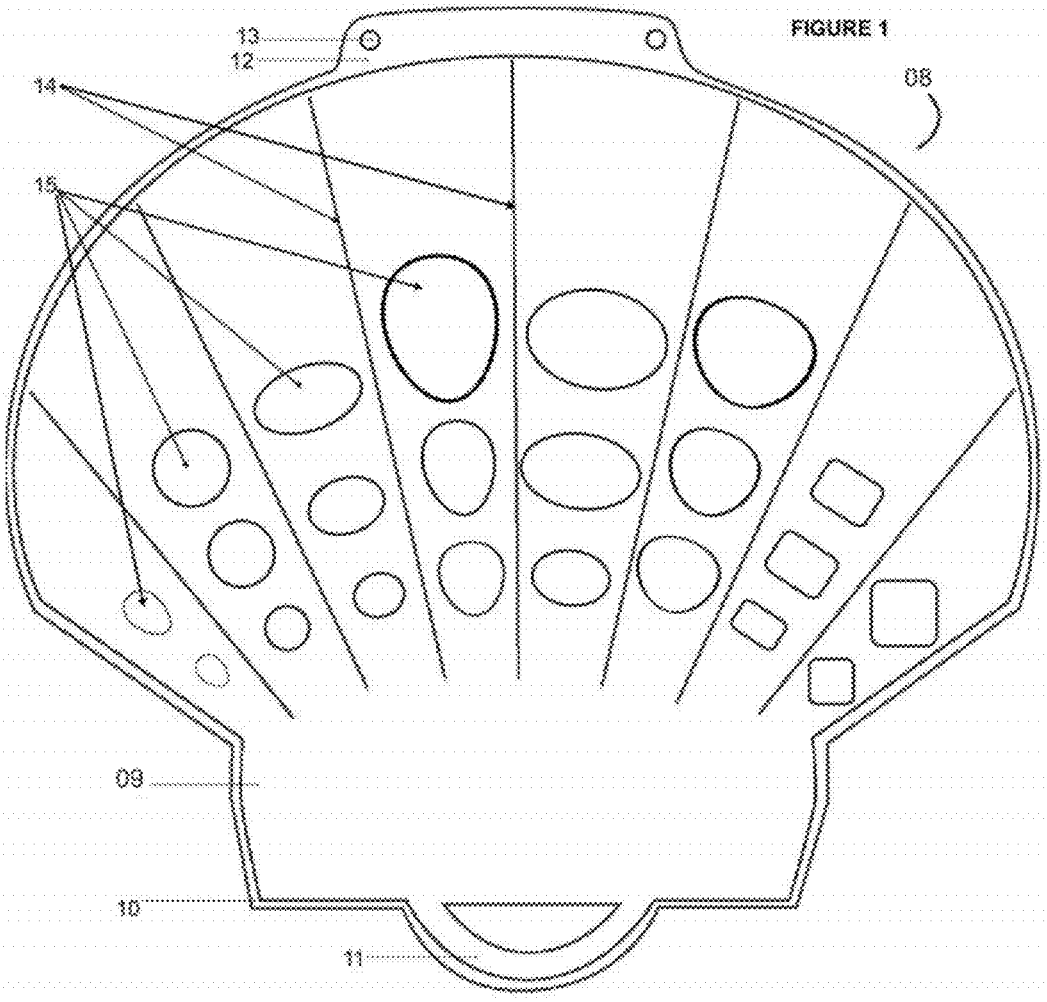
FIG. 1 is a top plan view of a seashell game according to an embodiment of the present invention.
Figure 2:
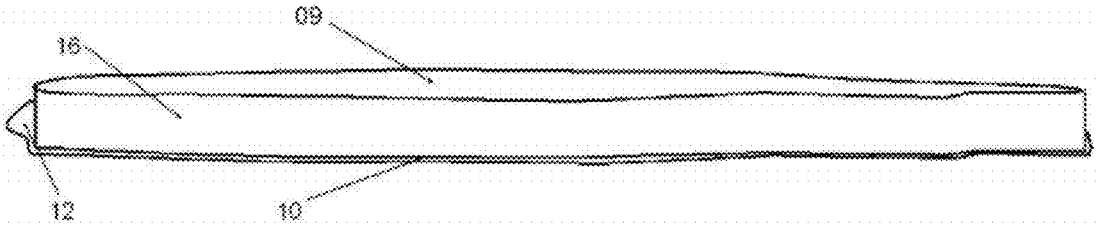
FIG. 2 is a side perspective view of the seashell game shown in FIG. 1.
Figure 3:
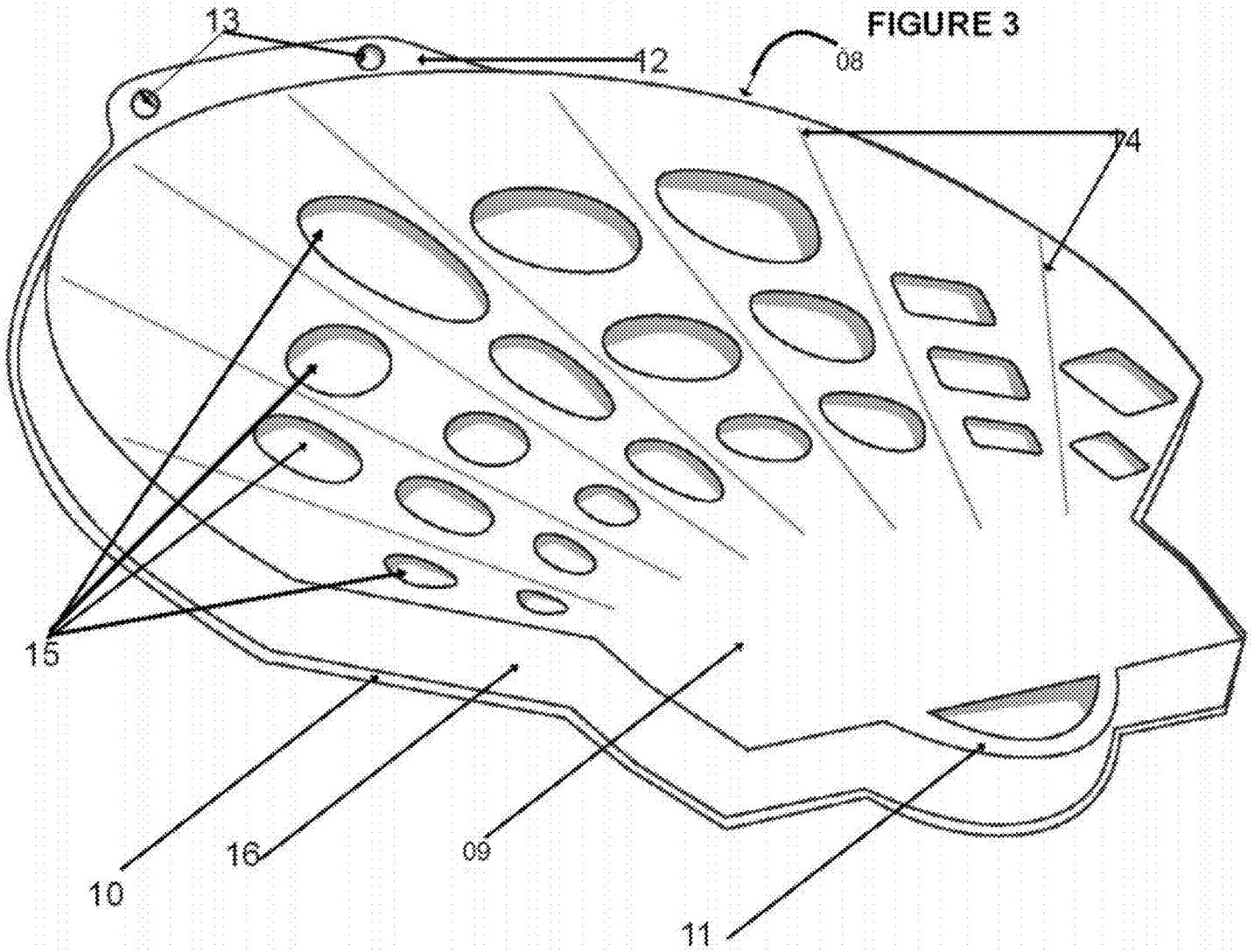
FIG. 3 is an oblique perspective view of the seashell game shown in FIG. 1.

With reference to the figures, like references refer to like elements in the several drawings. Referring now to FIGS. 1-3, a top plan view, a side perspective view, and an oblique perspective view of a game base 08 are shown respectively. Game base 08 may be formed or machined in an approximate shape of a scallop shell, and may have a game face 09 on one side, which may have a plurality of ribs 14 formed therein. The plurality of ribs 14 may accentuate the likeness of game base 08 to a scallop shell and may provide rigidity to game base 08. The plurality of ribs 14 may divide a plurality of indents 15, which may be formed on game face 09 and may be configured to contain or hold, for example, a sea shell. The plurality of indents 15 may have varying size, color, shape, and orientation, and may be configured to be a positive or negative mold of a seashell that may correspond to a label (not pictured) that may be affixed to a front side of game face 09. The label may be permanently applied to game face 09 using, for example, screen printing, and may include names of seashells, types of seashells, illustrations of seashells, point values, logos, and other information related to the seashell game. The label may include names and illustrations of seashells from different regions or geographic areas.

Game base 08 may have an upper extended flange 12 on a side thereof, which may have a hole 13 formed or machined therein. Hole 13 may be used, for example, to support or hang game base 08 for display or storage purposes. Game base 08 may have a handle 11 on a side thereof, which may be configured to be grasped by a user. Game base 08 may have a side 16, which may run for a length around a perimeter of game base 08 and may be adjacent to game face 09. Game base 08 may have a flange 10, which may run for a length around a perimeter of game base 08 and may extend from side 16. Side 16 and flange 10 may be configured to provide height to game base 08 and may enable game base 08 to be partially buried, for example, in sand during use.

Referring now to FIGS. 4-5, a top plan view and a side perspective view of a cover 19 are shown respectively. Cover 19 may have an upper flange 18 on a side thereof, which may be configured to correspond to and engage with upper extended flange 12. Cover 19 may have a side 17 that may run for a length around a perimeter of cover 19, and may be configured to correspond to or engage side 16. Cover 19 may be similarly formed or machined in an approximate shape of a scallop shell.

In an exemplary embodiment, elements described herein including game base 08 and cover 19 may be formed using styro-foam, plastic mold injection or thermo form molding or any combination thereof. Game face 09 may be a surface suitable for drawing or writing upon using, for example, a dry erase marker. Game face 09 may be suitable for attaching or adhering a static sticker or re-sealable label thereto.

In another embodiment, cover 19 may be configured to connect to or engage with game base 08 using, for example, a button, a snap, a hook and loop enclosure, an interference fit, a magnet, or a clasp.

In an exemplary embodiment, game base 08 may be about twenty-four (23) inches wide, and side 16 may be about two (2) inches wide.

It should be understood, of course, that the foregoing relates to exemplary embodiments of the invention and that modifications may be made without departing from the spirit and scope of the invention as set forth in the following claims.

What is claimed is:

1. A seashell storage and gaming device, comprising:

a cover; and a game base, the game base being formed in the shape of a seashell, the game base comprising:

a game face formed on a side of the game base;

a plurality of indents formed on the game face, wherein each of the plurality of indents is a different size, and wherein each of the plurality of indents is designed to receive a different size seashell;

a plurality of ribs formed on the game face, wherein the plurality of ribs being positioned on the game face such that each of the plurality of ribs divide, at least, a first portion of the plurality of indents from a second portion of the plurality of indents wherein each of the first and the second portion comprise, at least, two of the plurality of indents, wherein each of the plurality of indents are separate from and independent of the plurality of ribs formed on the game face; and a plurality of labels applied to the game face, wherein each of the plurality of labels identifies a different seashell;

wherein the cover is configured to fit over the game face.

2. A seashell game board and storage device, comprising:

a first part and a second part, the first part comprising a plurality seashell receiving indents formed thereon and a plurality of ribs formed thereon, wherein each of the plurality of ribs extends from an upper portion of the first part to a lower portion of the first part, wherein each of the plurality of ribs is extended between a first set of the plurality of indents and a second set of the plurality of indents, wherein the plurality of ribs do not form part of any of the plurality of indents, wherein the first set of the plurality of indents comprise, at least, two of the plurality of indents and the second set of the plurality of indents comprise, at least, two of the plurality of indents, and wherein the first set of the plurality of indents is different from the second set of the plurality of indents, and wherein the second part is a cover for the first part; and a plurality of seashell identifiers, each being affixed to a portion of the game face such that each of the plurality of seashell identifies demonstrate a type of seashell to be received by each of the plurality of indents.

* * * * *